US007219610B2

(12) United States Patent
von Wedel

(10) Patent No.: US 7,219,610 B2
(45) Date of Patent: May 22, 2007

(54) GRATE PLATE ARRANGEMENT FOR STEP PLATES

(75) Inventor: Karl von Wedel, Neustadt (DE)

(73) Assignee: IKN GmbH, Neustadt (DE)

( * ) Notice: Subject to any disclaimer, the term of this patent is extended or adjusted under 35 U.S.C. 154(b) by 0 days.

(21) Appl. No.: 11/202,984

(22) Filed: Aug. 12, 2005

(65) Prior Publication Data

US 2006/0037601 A1 Feb. 23, 2006

(30) Foreign Application Priority Data

Aug. 18, 2004 (DE) ..... 10 2004 040 048

(51) Int. Cl.
*F23H 5/08* (2006.01)

(52) U.S. Cl. ..... 110/298; 198/860.5; 432/78; 126/163 R

(58) Field of Classification Search ..... 110/298, 110/299, 300; 432/78; 126/163 R; 198/860.5
See application file for complete search history.

(56) References Cited

U.S. PATENT DOCUMENTS

| | | | | | |
|---|---|---|---|---|---|
| 1,983,709 | A | * | 12/1934 | Schmidt | 110/267 |
| 3,987,738 | A | * | 10/1976 | Korting | 110/272 |
| 4,002,148 | A | * | 1/1977 | Harding | 122/149 |
| 4,201,545 | A | * | 5/1980 | Riechert | 432/239 |
| 4,239,029 | A | * | 12/1980 | Martin et al. | 126/163 R |
| 4,250,819 | A | | 2/1981 | Pauli | |
| 4,471,704 | A | * | 9/1984 | John et al. | 110/281 |
| 4,498,634 | A | * | 2/1985 | Nelson et al. | 241/72 |
| 4,537,140 | A | * | 8/1985 | Baker | 110/281 |
| 4,671,310 | A | * | 6/1987 | Henninger | 137/242 |
| 4,694,757 | A | * | 9/1987 | Hawkins et al. | 110/271 |
| 4,732,561 | A | * | 3/1988 | Eiring et al. | 432/78 |
| 4,995,757 | A | * | 2/1991 | Prescott | 404/26 |
| 5,174,747 | A | * | 12/1992 | Massaro et al. | 432/78 |
| 5,322,434 | A | * | 6/1994 | Milewski et al. | 432/78 |
| 5,549,471 | A | * | 8/1996 | Tegtmeier et al. | 432/77 |
| 5,551,356 | A | * | 9/1996 | Post | 110/269 |
| 5,572,937 | A | * | 11/1996 | Tegtmeier et al. | 110/300 |
| 5,575,642 | A | | 11/1996 | Willis et al. | |
| 5,626,089 | A | * | 5/1997 | Schneider et al. | 110/281 |
| 5,724,898 | A | * | 3/1998 | von Bockh et al. | 110/291 |
| 5,862,906 | A | | 1/1999 | Von Wedel | |
| 6,155,184 | A | * | 12/2000 | Stiefel | 110/348 |
| 6,266,883 | B1 | * | 7/2001 | Heinemann et al. | 29/896.6 |
| 7,021,928 | B1 | * | 4/2006 | Fehsenmayr et al. | 432/78 |

FOREIGN PATENT DOCUMENTS

| | | |
|---|---|---|
| EP | 0 740.766 B1 | 3/2000 |

* cited by examiner

*Primary Examiner*—Joe Dillon, Jr.
(74) *Attorney, Agent, or Firm*—Quarles & Brady LLP

(57) ABSTRACT

A grate plate arrangement for step grates includes box-like grate plates (4) positioned on a grate carrier (2) with a front plate (24) placed on its end wall (18) and fastened to the end wall (18) using one or more studs (26) screwed to the grate plate (4). The bolt head (32) of each stud (26) is countersunk into a recess (34) built into the front plate (24) and covered on the outside by covering (cover 38) and secured against unscrewing.

18 Claims, 4 Drawing Sheets

GRATE PLATE ARRANGEMENT FOR STEP PLATES

CROSS REFERENCES TO RELATED APPLICATIONS

This application claims the priority benefit of German Patent Application No. 10 2004 040 048.2 filed on Aug. 18, 2004.

STATEMENT REGARDING FEDERALLY SPONSORED RESEARCH

Not Applicable.

DESCRIPTION OF THE BACKGROUND ART

This invention relates to a grate plate arrangement for step grates. Generally, step grates include several grate plates laid out beside each other on one grate carrier to form one grate plate row; several grate plate rows laid out behind each other in the conveying direction form the step grate. The grate plate rows have a stepped arrangement, that is, the front area of each grate plate row rests on the rear area of a following grate plate row in the conveying direction. To convey granulated materials lying on the grate, in general individual grate plate rows are arranged movable in the conveying direction while other grate plate rows remain immovable.

Special problem areas of this type of step grates are the end walls of the individual grate plates. On the one hand, the end walls of the grate plates of the movable grate plate rows transport granulated materials in the conveying direction, thus subjecting them to particular wear and tear. On the other hand, the end walls of each grate plate row, together with the following grate plate row moving relative to it, form an open motion gap that prevents damaging friction, which would lead to increased wear and loss of driving power, from occurring in the overlapping area of the grate plate rows moving relative to each other. The motion gap is generally blown free by a flow of cooling air passing through it. It must be dimensioned as narrow as possible so that the proportion of cooling air emerging from the motion gap does not become uncontrolled large.

It is already known from EP 0 740 766 B1 that attaching a height-adjustable front plate to the end wall of a grate plate will allow for the precise adjustment of the motion gap. The front plates are fastened using studs which penetrate through oblong holes formed in the front plate and screwed into tapped holes formed in the grate plate. After installation, the studs are welded to the front plate and the front plate itself is welded to the grate plate. This allows the structure to bear the significant loads occurring during operation. The front plates are preferably manufactured from a heat-resistant and abrasion-resistant material.

Direct contact with the extremely abrasive material conveyed significantly wears out the bolt heads. If the front plates have to be readjusted after a longer operating period in order to readjust the motion gap increased by wear and tear, then the bolt heads have to be cut off and the shanks of the studs removed and discarded. Another disadvantage of this known arrangement lies in the fact that the studs are exposed to a high-temperature load through direct contact with the hot material, making the use of a high-temperature material necessary.

SUMMARY OF THE INVENTION

The task of this invention is to create a grate plate arrangement for step grates where the studs are protected from direct contact with the granulated materials and hence from strong wear and tear and thermal stress. According to the invention, this task is accomplished by covering the bolt heads of the studs by a cover.

Covering the bolt heads prevents the studs from being directly exposed to the effects of heat through the granulated materials, making the use of studs made of high-temperature material unnecessary. Moreover, the bolt heads are protected against the abrasive effect of the granulated materials and hence from wear and tear, making them easily detachable by normal means using a wrench if and when the front plate has to be readjusted. Another advantage is that the studs can be reused.

According to one embodiment of the invention, the bolt heads are each fastened in a recess countersunk into the front plate so that they do not protrude and so that the front plate can be positioned directly against the end wall of the grate plate, which is shown in the exemplary embodiments.

Basically, when using several studs one can arrange several or all bolt heads in one common recess and, for example, cover them with one common cover or hold each of them in their own recess and cover them with associated covers.

A preferred design of the invention provides for the recess to hold the bolt head to be built into the face of the front plate opposite the end wall of the grate plate. On the base of the recess is a hole for the shaft of the stud penetrating through the front plate. The coverings are formed as one cover sealing the recess. This design permits an especially simple installation where the front plate is installed from the front into the desired position on the end wall of the grate plate and is at least temporarily fixed by tightening the studs.

The invention provides for the recess being formed by a dead-end groove extending inwards from one outer edge, preferably the top edge of the front plate, and the cover being insertable into this groove from outside. According to another version of this embodiment, the sides of the groove are each equipped with a guide profile and the cover has the form of a sliding plate inserted into this groove from outside and equipped on its sides with counter-profiles corresponding to the guide profiles of the groove.

To be able to remove the cover more easily from the grooves when readjusting the front plate and thus make the bolt heads accessible, it is further provided to have the sides of the groove and, accordingly, the sides of the cover slightly converge in the sliding direction of the cover. In this way, the slots of the groove and the counter-profiles of the cover come out of contact when the cover moves slightly outwards, allowing for easy removal of the cover.

According to one favorable mechanical design, the cover has a lip on its rear edge in sliding direction extending towards the end wall of the grate plate. This lip inserts into a corresponding recess in the associated outer edge of the front plate when the cover is installed. On the one hand, the lip can serve as a stop defining the end position of the cover; on the other hand, the lip covers the gap between the opposing surfaces of the cover, on one side, and the front plate, on the other, and hence the recess where the bolt head is located.

To protect the cover itself against wear and tear, it is provided to have the cover be flush with the face of the front plate when the cover is installed, and preferably to have the lip on the cover be flush against the outer edge of the front plate as well.

To be able to adjust the front plate to different heights, the hole in the front plate is made in the form of an oblong hole extending from top to bottom in a known manner.

According to another design, there is an exchangeable, vertically movable sealing lip on the bottom edge of the front plate. This lip is pressed against the top side of the following grate plate by its own weight or, optionally, aided by spring force, thereby keeping the sealing clearance closed.

After the cover is inserted in position covering the recess, it is suitably fastened on the front plate. It is preferable to have the cover welded to the front plate. To be able to dismantle the front plate for the purpose of readjustment, one only needs to undo the weld seam between cover and front so that the cover can be removed in the manner described below and the bolt head of the stud becomes accessible.

To rule out any undesired loosening of the stud, for example caused by vibrations during operation, another embodiment of the invention provides that the cover exhibit on its inner side, the side toward the stud, lateral steps that engage the wrench flats of the stud to prevent the head from turning.

The bolt head must then be designed and installed so that these wrench flats are somewhat parallel to the sliding direction of the cover in order for the side steps of the cover to lie against the wrench flats.

According to another mechanical design of the invention, the recess is built into the locating face of the front plate opposite the end wall of the grate plate and basically has the form of a dead-end T-groove extending inwards from one outer edge, preferably the bottom edge of the front plate. The stud is installed before the front plate is placed so that the bolt head keeps a prescribed distance from the end wall of the grate plate in order that the front plate can slide over the bolt head with the T-groove. The bolt head thus forms a sliding block matching the shape of the T-groove. The outward cover of the recess is formed by the rear wall of this recess.

In order to allow for rotary fixation of the stud in this design, it is provided to have the sides of the recess positioned against the wrench flats of the bolt head when the front plate slides on. In this configuration the bolt heads have to be suitably designed and aligned during installation so that they lie essentially parallel to the sliding direction of the front plate so that the sides of the recess can align to the wrench flats of the bolt head.

To install the front plate, first the studs are installed on the grate plate so that the front plate can be slid onto the bolt heads in close alignment to the end wall of the grate plate. The front plate is then fixed in the desired position and preferably welded to the grate plate. To disassemble the front plate, one only has to undo the weld seam between front plate and grate plate so that the front plate becomes removable.

BRIEF SUMMARY OF THE DRAWINGS

Several embodiments of the invention are shown in the drawings and described in more detail hereinafter. In the drawings.

DETAILED DESCRIPTION OF THE PREFERRED EMBODIMENTS

Figure 1:
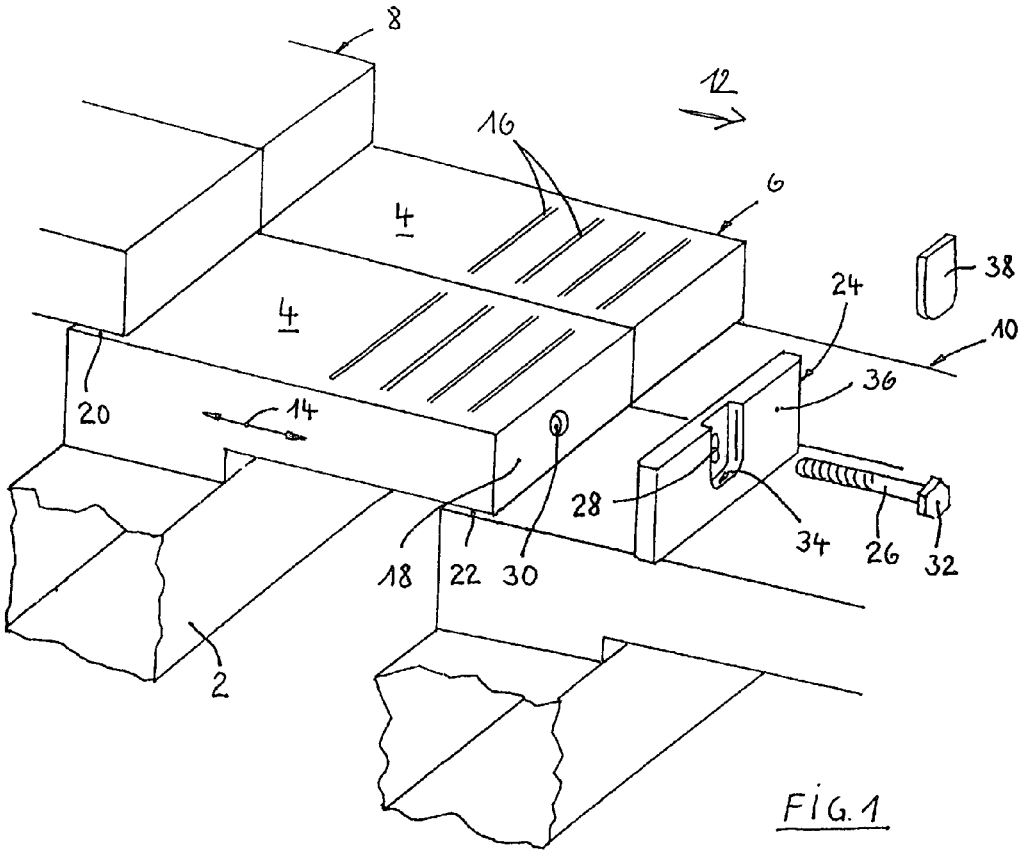
FIG. 1 is a schematic diagram of a partial view of a step grate.

The basic setup of a step grate, to which the present invention relates, is shown in FIG. 1. Several grate plates 4 laid out beside each other on a grate carrier 2 form a grate plate row 6. Several grate plate rows 8, 6, 10 laid out one after the other form the grate, which as such, is already generally known and therefore not described here in more detail. The grate plate rows 8, 6, 10 laid out one after the other each have a stepped overlapping arrangement so that the front area of the grate plates of one grate plate row is resting on the rear area of the grate plates of the grate plate row following in the conveying direction 12. In the example of FIG. 1, grate plate row 6 is movable back and forth in the direction of double arrow 14, while grate plate rows 8 and 10 are stationary grate plate rows. Other arrangements where several movable grate plate rows alternate with several immovable ones are possible.

The granulated materials resting on the grate are cooled by the cooling air conveyed, for example, through grate carrier 2 and through the slots 16 formed on the top side of grate plates 4. The granulated materials are conveyed in conveying direction 12 by the forward and backward motion of movable grate plate row 6 (and is supported by the cooling air blowing, for example, forward obliquely).

In the overlapping areas between the individual grate plate rows, that is, for example, between stationary grate plate row 8 and movable grate plate row 6, on the one hand, and movable grate plate row 6 and stationary grate plate row 10, on the other, are so-called motion gaps 20 or 22, that is, the grate plate rows must not come into contact within these areas. Generally, motion gaps 20, 22 are blown free by cooling air conveyed from the compartment underneath the grate. The width of the motion gaps must be kept as small as possible so that uncontrolled large amounts of cooling air do not leak out of them. However, one cannot prevent granulated materials from penetrating motion gaps 20, 22, whereby wear and tear expands them during longer operation periods. It is therefore desired to be able to readjust motion gaps 20, 22 at specific time intervals.

FIG. 1 shows one possible embodiment of a front plate 24 attachable to end wall 18. Other versions are shown in the other drawings and are described with them. All solutions are common in that they protect the bolt heads from getting in direct contact with the material to be conveyed.

Number 24 is a front plate that can be fastened to end wall 18 using stud 26. The stud 26 penetrates through a hole 28 in the front plate 24 and is screwed into a tapped hole in the grate plate 4. Either the opening 30 in the end wall 18 is constructed like a tapped hole or the stud 26 penetrates through the opening 30 and is screwed into a tapped hole provided inside the grate plate 4.

The hole 28 is an oblong hole extending from top to bottom so that the front plate 24 becomes height-adjustable. In this manner, any desired motion gap can be adjusted between the bottom edge of the front plate 24 and the respective grate plate following in the conveying direction 12.

As can be seen from FIG. 1, the bolt head 32 of the stud 26 is countersunk in a recess 34, on the face 36 of the front plate 24 opposite the end wall 18 of the grate plate 4. The recess 34 can be covered on the outside with a cover 38 that can be slid into it from the top so that the bolt head 32 is protected. To fasten the cover 38 to the front plate 24, it is welded to the front plate 24 and/or the grate plate 4 after installation.

If the front plate 24 has to be loosened, for example, in order to readjust the motion gap, one simply has to undo the weld seam between cover 38 and front plate 24 and to remove the cover 38 so that the bolt head 32 becomes accessible and detachable using a suitable tool. This way the front plate 24 can be readjusted several times, with the cover 38 and the stud 26 remaining reusable.

Figure 2:
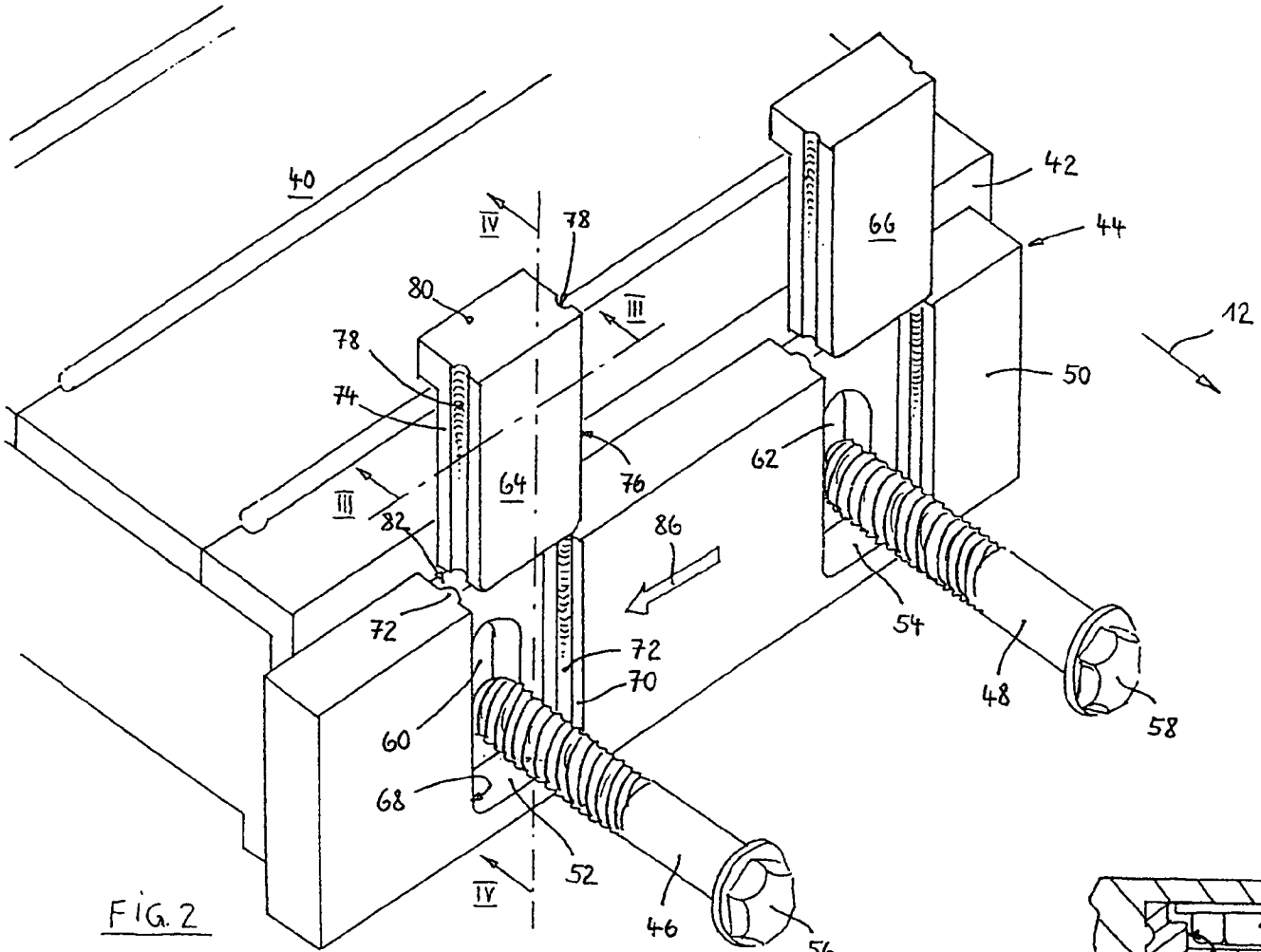
FIG. 2 is a perspective exploded view of the end wall area of a grate plate and a front plate to be installed on the end wall.

FIG. 2 shows in detail the front area (in conveying direction 12) of a grate plate 40 as well as a front plate 44 attachable to the end wall 42 of the grate plate 40. The front plate 44 essentially only differs from the front plate 24 shown in FIG. 1 in that, instead of one stud, two identical studs 46, 48 are used to fasten the front plate 44 to the end wall 42 of the grate plate 40. In the face 50 of the front plate 44 facing away from the end wall 42 are two recesses 52, 54, in which the bolt heads 56, 58, respectively, can be countersunk. On the base of each recess 52, 54 is an oblong hole 60 and 62 extending from top to bottom, through which the associated studs 46, 48 penetrate so that they can be screwed to the grate plate 40 in a manner that is not described in detail. The holes 60, 62 are constructed as oblong holes to allow for adjustment of the front plate 44 to different height positions and thus for setting any motion gap between the bottom edge of the front plate 44 and the next grate plate.

The recesses 52, 54 are constructed as dead-end grooves extending downwards from the top edge of the front plate 44. They can be covered by associated covers 64, 66. Since the recesses 52, 54 as well as their respective studs 46, 48 and covers 64, 66 are designed identically, only the arrangement shown to the left in FIG. 2 will be described in detail.

The sides 68, 70 of the recess 52 each have a guide profile 72. Accordingly, the cover 64 has corresponding counter-profiles 78 on its sides 74, 76 so that the cover 64 can be slid into the recess 52 like a sliding plate to cover the recess as well as the bolt head 56 within it.

The cover 64 has a lip 80 on its top or rear edge in sliding direction extending out towards the end wall 42. This lip inserts into a corresponding recess 82 in the top edge of the front plate 44 when the cover 64 is installed. The cover 64 is laid out so that when installed it is flush with the face 50 of the front plate 44 and the lip 80 is flush with the top edge of the front plate 44.

Figure 3:
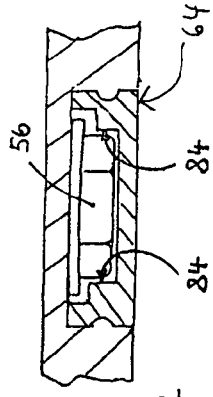
FIG. 3 is a cross-section through a cover along the section line III—III.

It is preferable to construct the recess 52 as slightly converging in the sliding direction to simplify the removal of the cover 64 from the recess 52. Once installed, preferably, the cover 64 is welded to the front plate 44 and/or the grate plate 40 and thus fastened. FIG. 3 shows a cross-section of the cover 64 corresponding to the section line III—III in FIG. 2. As can be seen in FIG. 3, side lips 84 are built on its inner side facing the bolt head 56, engaging the wrench flats of the bolt head 56 when installed, and securing the bolt head 56 against turning.

Figure 4:
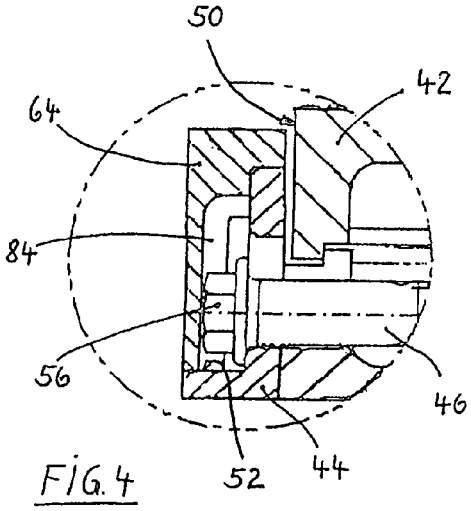
FIG. 4 is a section approximately corresponding to the section line IV—IV in FIG. 2, but in installed condition.

FIG. 4 shows a longitudinal section of the cover 64 according to the section line IV—IV in FIG. 2, viewed in the direction of the arrow 86. What can be seen is the end wall 42 of the grate plate 40, the front plate 44 positioned next to the face 50 of the end wall 42, the stud 46 fastening the front plate 44 and countersunk in the recess 52, and the cover 64 covering the recess 52 against the outside. Furthermore, one can see the side lip 84 positioned against one wrench flat of the bolt head 56 opposite the viewer.

Figure 5:
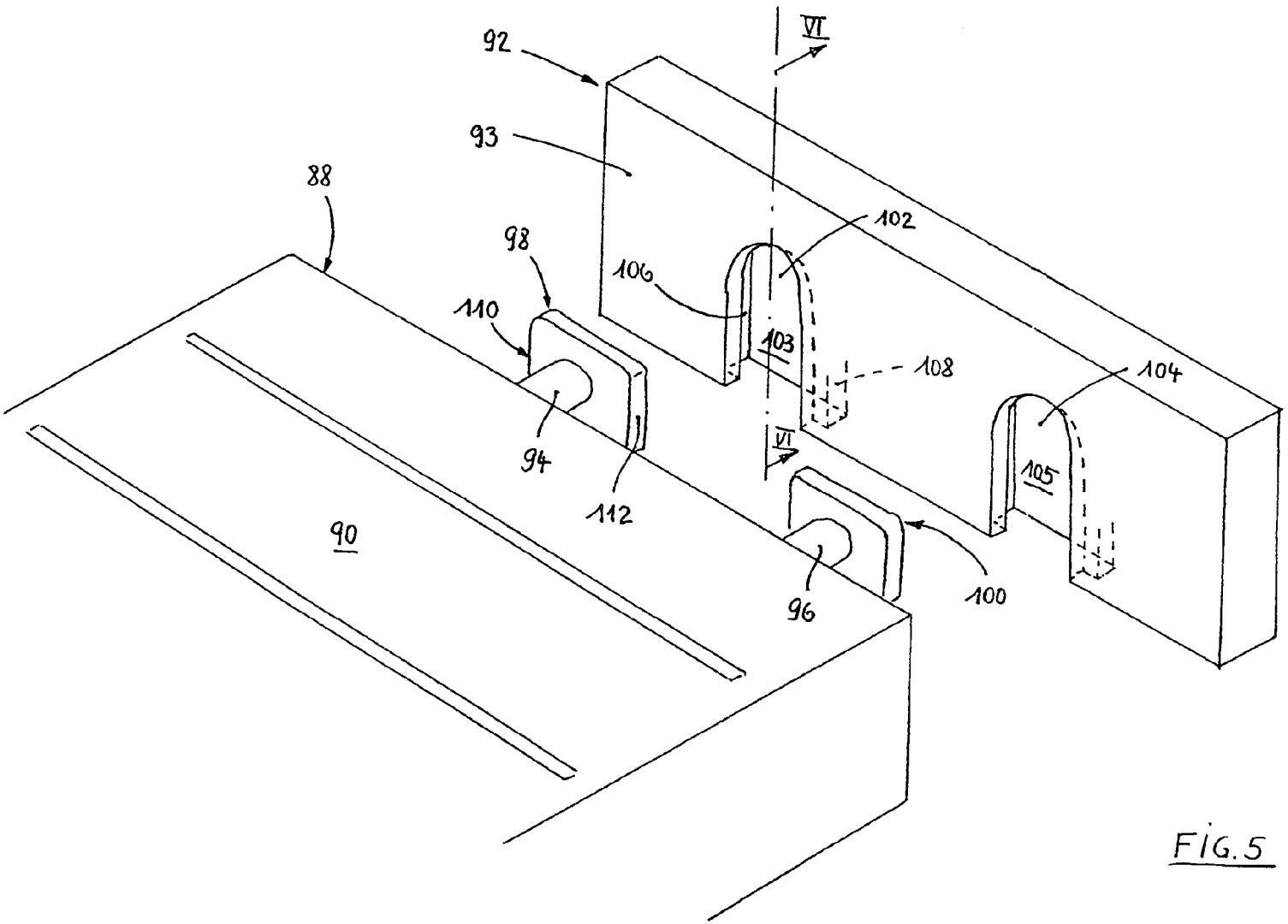
FIG. 5 is a perspective exploded view of the end wall area of a grate plate as well as a front plate to be installed on the end wall according to another embodiment of the invention.

FIG. 5 shows another embodiment of a front plate 92 attachable to the end wall 88 of a grate plate 90. In order to fasten the front plate 92, two studs 94, 96 are screwed so far into the end wall 88 that the bolt heads 98 and 100 keep a prescribed distance from the end wall 88, allowing one to slide the front plate over the bolt heads close to the end wall 88.

In the locating face of the front plate 92 opposite the end wall 88 of the grate plate 90 are two dead-end recesses 102, 104 extending upwards from the bottom edge and having a T-groove-like cross-section. The front plate 92 is fastened to the end wall 88 of the grate plate 90 by sliding the recesses 102, 104 from the top over the associated bolt heads 98 or 100 respectively. The bolt heads 98, 100 are thus covered against the outside by the bottom walls 103, 105 of the recesses 102, 104. Afterwards, the front plate 92 is fastened permanently to the grate plate 90, preferably by welding. To disassemble the front plate, one only has to undo the weld seam between the front plate 92 and the grate plate 90. The studs 94, 96 and the front plate 92 can be used several times in this embodiment as well.

The recesses 102, 104, on the one hand, and the bolt heads 98, 100, on the other, are laid out and dimensioned so that sides (e.g. 106, 108) of the recess 102 rest against wrench flats (e.g. 110, 112) of the associated bolt head 98 when the front plate 92 is slid on and thus secure the bolt head from turning.

Figure 6:
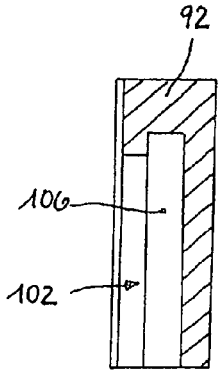
FIG. 6 is a section corresponding to the section line VI—VI in FIG. 5.

FIG. 6 shows a cross-section of the front plate 92 corresponding to the section line VI—VI in FIG. 5. One can once again see the shape of the T-groove recess 102 with a lateral surface 106, which rests against the bolt head 98 and secures it from turning.

Figure 7:
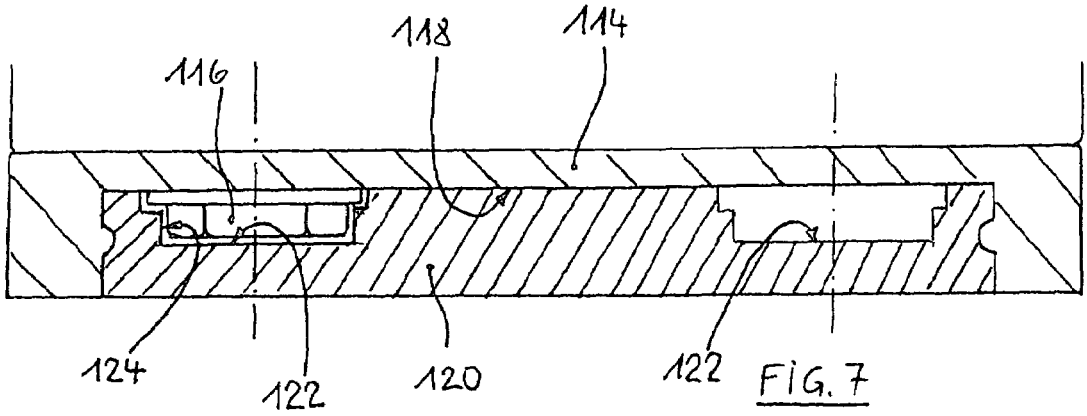
FIG. 7–9 are different versions of front plate and coverings.
Figure 8:
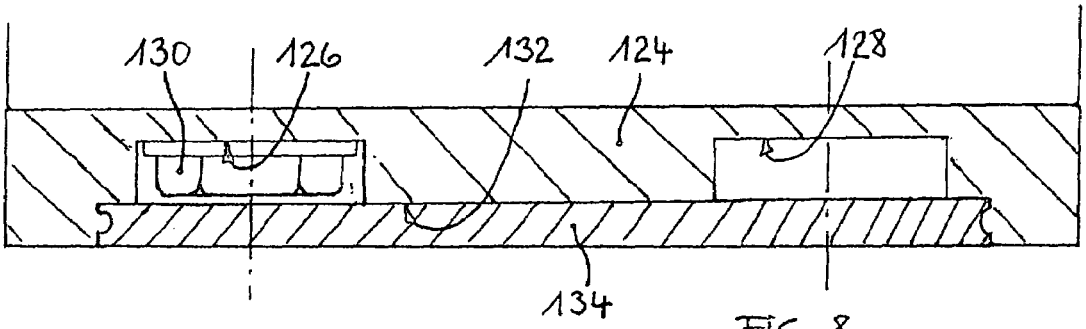
Figure 9:
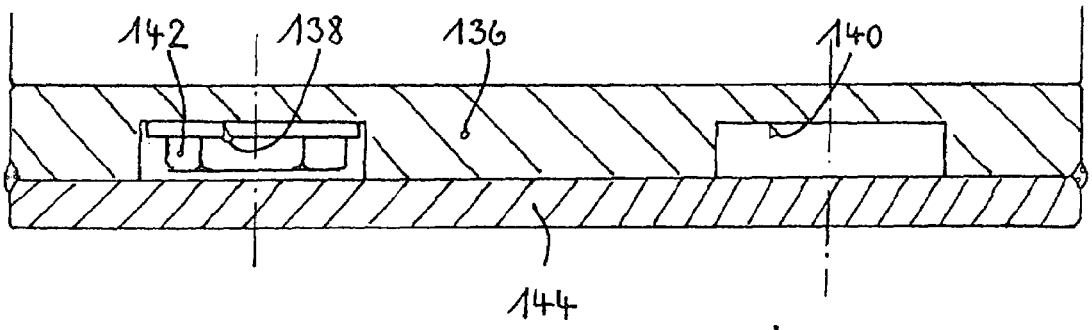

FIGS. 7 to 9 shows different solutions for the design of the front plate.

FIG. 7 shows a front plate 114, which is fastened to the end wall of a grate plate with two studs (where, to simplify matters, only one stud is shown with the bolt head 116). On the front plate 114 is a recess 118 for reception of both bolt heads, which, once the studs are installed, is covered by a cover 120 slid into the recess 118. In the area of the bolt heads the cover 120 has a similar shape as the covers 64, 66 in FIG. 2, that is, the recesses 122 holding the bolt heads have side lips 124, which rest against the wrench flats of the bolt heads aligned accordingly and secure them from turning (this does not need to be shown in more detail again).

FIG. 8 shows a front plate 124 with two separate recesses 126, 128 for two studs, of which only the bolt head 130 of one stud is displayed. The recesses 126, 128 are covered by a cover 134 slid into in a corresponding recess 132 in the front plate 124 to such an extent that the cover 134 is flush with the outer surface of the front plate 124.

FIG. 9 shows a front plate 136 with two recesses 138, 140 for two studs, of which only the bolt head 142 of one stud is shown. The recesses are covered by a cover 144 attachable to the outer surface of the front plate 136 and, for example, welded to it.

Figure 10:
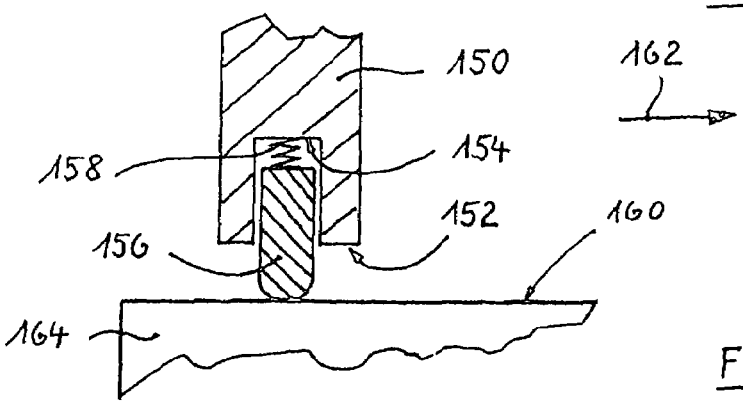
FIG. 10 is a sectional view of a front plate with sealing lip.

Finally FIG. 10 shows a cross-section of a front plate 150 in the area of its bottom edge 152. In one groove 154 in the bottom edge 152 a freely vertically movable sealing lip 156 is arranged, which rests against the top edge 160 of a grate plate 164 following in the conveying direction 162, for example, only by virtue of its own weight or through the force of spring means 158 in the groove. The sealing lip 156 is, for example, made of a low-wear material and preferably easily exchangeable and replaceable with a new one.

While there have been shown and described what is at present considered the preferred embodiments of the invention, it will be obvious to those skilled in the art that various changes and modifications can be made therein without departing from the scope of the invention defined by the appended claims.

I claim:

1. A step grate plate arrangement, said grate plate arrangement comprising:

a box-like grate plate mounted on a grate carrier for movement in a forward direction and a backward direction and having an end wall facing said forward direction;

a second plate engaging material on said grate carrier, said second plate positioned on said end wall and fastened to said end wall using at least one stud screwed onto the grate plate, said at least one stud including a bolt head (56, 58; 98, 100); and a cover (covers 64, 66; bottom walls 103, 105) covering said bolt head to the outside.

2. The grate plate arrangement according to claim 1, in which said bolt head (56, 58; 98, 100) is countersunk in a recess (52, 54; 102, 104, 118) built into the second plate (44; 92).

3. The grate plate arrangement according to claim 2 including a plurality of studs, each of said studs accommodated in one recess (118).

4. The grate plate arrangement according to claim 2 including a plurality of studs, in which each stud of said plurality of studs (46, 48; 94, 96) is assigned its own recess (52, 54; 102, 104).

5. A grate plate arrangement for step grates, said grate plate arrangement comprising:

a box-like grate plate mounted on a grate carrier with a second plate positioned on an end wall of said grate plate and fastened to said end wall using at least one stud screwed onto the grate plate, said at least one stud including a bolt head (56, 58; 98, 100) covered to the outside by a cover (covers 64, 66; bottom walls 103, 105), said bolt head (56, 58; 98, 100) being countersunk in a recess (52, 54; 102, 104, 118) built into the second plate (44; 92), wherein said recess (52) is built into the face (50) of the second plate (44) facing away from the end wall (42) of the grate plate (40), where the base of the recess (52) has a hole (60) pierced through the second plate (44) for the shaft of a stud (46), and that the cover (64) seals the recess (52).

6. The grate plate arrangement according to claim 5, in which said recess (52) is in the shape of a dead-end groove extending inwards from one outer edge, preferably the top edge of the second plate (44).

7. The grate plate arrangement according to claim 6, in which sides (68, 70) of the recess (52) each have a guide profile (72), and that the cover (64) is in the form of a slide plate slid from outside into the recess (52) and configured on its sides (74, 76) with counter-profiles (78) corresponding to the guide profiles (72).

8. The grate plate arrangement according to claim 6, in which said sides (68, 70) of the recess (52) and, accordingly, the sides (74, 76) of the cover (64) converge slightly in the sliding direction of the cover.

9. The grate plate arrangement according to claim 6, in which said cover (64) has a lip (80) extending towards the end wall (42) of the grate plate (40) on its rear edge pointing towards the sliding direction, and this lip, when the cover (64) is installed, inserts into a corresponding recess (82) in the associated outer edge of the second plate (44).

10. The grate plate arrangement according to claim 9, in which in installed condition said cover (64) is flush with the face (50) of the second plate (44) and/or the lip (82) built into the cover (64) is flush with the associated outer edge of the second plate (44).

11. The grate plate arrangement according to claim 5, in which said hole (60) in the second plate (44) is constructed as an oblong hole extending from top to bottom.

12. The grate plate arrangement according to claim 5, in which said cover (64) has side lips (84) on its inner side opposite the bolt head (56), which lips engage the wrench flats of the bolt head (56) when installed, securing the bolt head from turning.

13. The grate plate arrangement according to claim 5, in which said cover (64) is fastened to the second plate (44) in its position covering the recess (52).

14. The grate plate arrangement according to claim 13, in which said cover (64) is welded to the second plate (44) and/or the face (42) of the grate plate (40).

15. A grate plate arrangement for step grates, said grate plate arrangement comprising:

a box-like grate plate mounted on a grate carrier with a second plate positioned on an end wall of said grate plate and fastened to said end wall using at least one stud screwed onto the grate plate, said at least one stud including a bolt head (56, 58; 98, 100) covered to the outside by a cover (covers 64, 66; bottom walls 103, 105), said bolt head (56, 58; 98, 100) being countersunk in a recess (52, 54; 102, 104, 118) built into the second plate (44; 92), wherein said recess (102) is built into a face (93) of the second plate (92) facing the end wall (88) of the grate plate (90) and essentially has the shape of a dead-end T-groove extending inwards from an outer edge, the bottom edge of the front plate (92), and that the stud (94) is installed at such a distance between bolt head (98) and end wall (88) of the grate plate (90) so that the front plate (92) can be slid onto the bolt head (98) with the T-groove-shaped recess (102).

16. The grate plate arrangement according to claim 15, in which sides (106, 108) of the recess (102) can be positioned against wrench flats (110, 112) of the bolt head (98) when inserting the second plate (92) in such as way that the bolt head (98) is secured from turning.

17. The grate plate arrangement according to claim 15, in which said second plate (92) when installed is welded to the end wall (88) of the grate plate (90).

18. The grate plate arrangement according to claim 1, in which on a bottom edge of the second plate (150) there is a vertically movable sealing lip (156), resting against the top side (160) of a following grate plate (164) by virtue of at least one of its own weight and by spring means (158).

* * * * *

UNITED STATES PATENT AND TRADEMARK OFFICE

CERTIFICATE OF CORRECTION

PATENT NO. : 7,219,610 B2
APPLICATION NO. : 11/202984
DATED : May 22, 2007
INVENTOR(S) : Karl von Wedel It is certified that error appears in the above-identified patent and that said Letters Patent is hereby corrected as shown below:

Column 7, Claim 1, lines 24-25, "a second plate engaging material on said grate carrier, said second plate positioned on said end wall ..." should be changed to -- a second plate engaging material on the step grate plate arrangement, said second plate positioned on said end wall... --.

Signed and Sealed this

Seventh Day of August, 2007

JON W. DUDAS
*Director of the United States Patent and Trademark Office*